US006853154B2

(12) United States Patent
Erhardt

(10) Patent No.: US 6,853,154 B2
(45) Date of Patent: Feb. 8, 2005

(54) OPEN LOOP BI-LEVEL BALLAST CONTROL

(75) Inventor: Robert A. Erhardt, Schaumburg, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/135,347

(22) Filed: Apr. 30, 2002

(65) Prior Publication Data

US 2003/0201733 A1 Oct. 30, 2003

(51) Int. Cl.[7] ..... G05F 1/00; H01K 1/62

(52) U.S. Cl. ..... 315/291; 315/224; 315/209 R

(58) Field of Search ..... 315/291, 224, 315/209 R, 240, 307, 311, 219, DIG. 4, 244, 211, 241, 225, DIG. 7, DIG. 5, 308; 323/211, 241

(56) References Cited

U.S. PATENT DOCUMENTS

| | | | | | |
|---|---|---|---|---|---|
| 5,719,471 | A | * | 2/1998 | Kachmarik | 315/209 R |
| 5,747,943 | A | * | 5/1998 | Houk et al. | 315/225 |
| 5,757,141 | A | * | 5/1998 | Wood | 315/224 |
| 5,808,423 | A | | 9/1998 | Li et al. | 315/313 |
| 5,844,380 | A | * | 12/1998 | Siepkes | 315/307 |
| 6,008,593 | A | * | 12/1999 | Ribarich | 315/307 |
| 6,011,360 | A | * | 1/2000 | Gradzki et al. | 315/244 |
| 6,072,284 | A | * | 6/2000 | Lin | 315/307 |
| 6,204,614 | B1 | | 3/2001 | Erhardt | 315/307 |
| 6,628,091 | B2 | * | 9/2003 | Griffin et al. | 315/291 |
| 2002/0097008 | A1 | * | 7/2002 | Krummel | 315/291 |
| 2002/0180378 | A1 | * | 12/2002 | Griffin et al. | 315/224 |

FOREIGN PATENT DOCUMENTS

| | | | |
|---|---|---|---|
| DE | 19629207 | 1/1998 | H05B/41/40 |
| WO | WO0069227 | 11/2000 | H05B/41/42 |

OTHER PUBLICATIONS

U.S. Appl. No.09/867,261, filed May 29, 2001, Griffin et al.

* cited by examiner

*Primary Examiner*—Don Wong
*Assistant Examiner*—Chuc Tran

(57) ABSTRACT

A system and method for open loop bi-level ballast control providing multiple levels of illumination from a ballast-driven lamp. Power to a lamp is adjusted in response to a lamp control signal by adjusting the frequency driving the ballast powering the lamp. Line voltage feeds an AC/DC converter, which supplies DC voltage to a high frequency (HF) ballast. A frequency control circuit responds to a lamp control signal and supplies a ballast frequency signal to the HF ballast, which responds to the ballast frequency signal and adjusts the current supplied to the lamp accordingly. In one embodiment, the lamp control signal can be a bi-level signal providing bi-level illumination.

9 Claims, 4 Drawing Sheets

OPEN LOOP BI-LEVEL BALLAST CONTROL

TECHNICAL FIELD

The technical field of this disclosure is lighting control, particularly, open loop bi-level ballast control.

BACKGROUND OF THE INVENTION

Bi-level switching of fluorescent lamps allows space to be illuminated as needed by providing a high level of illumination when the space is occupied and a lower level of illumination when it is not. This can be accomplished by lighting all of the fluorescent lamps for high level illumination and lighting some of the fluorescent lamps for lower level illumination. As an alternative, the lamps can be run at a reduced power level. Energy use and energy cost will be reduced if lights are switched off or run at a reduced power for lower level illumination. The illumination level can be controlled manually, with timers, or with sensors able to detect when the room is occupied.

Bi-level switching of fluorescent lamps has been accomplished using a triac to switch power at the ballast output, but using a triac does not allow continuous lighting. Such switching is described in U.S. Pat. No. 5,808,423 to Li et al., assigned to the same assignee as the present invention and incorporated herein by reference. The energy savings is accomplished by switching off one or more lamps. The ballast must be toggled off between the high power level of the high level illumination and the low power level of the lower level illumination because the triac remains latched until power is removed completely. This approach is inconvenient to the occupants, since the light is switched off to switch from high level to low level illumination.

U.S. Ser. No. 09/867,261 filed May 29, 2001, assigned to the same assignee as the present invention and incorporated herein by reference, improves bi-level ballast control through the use of an additional lead wire. Toggling of the input voltage is not required, but one or more lamps must still be switched off using a power switch and an optocoupler. Switching is also known to decrease the life of lamps and may decrease the useful life of other lighting system components.

U.S. Pat. No. 6,204,614 to Erhardt, assigned to the same assignee as the present invention and incorporated herein by reference, describes power level switching without the need to switch off lamps, which can even be used in single lamp systems. The system as described uses a ballast with a feedback loop, which can be more complex and costly than an open loop ballast. Open loop ballasts normally operate at a fixed frequency.

It would be desirable to have electronic switching for an open loop bi-level ballast control that would overcome the above disadvantages.

SUMMARY OF THE INVENTION

One aspect of the present invention provides open loop bi-level ballast control without the need to power off the ballast during switching.

Another aspect of the present invention provides open loop bi-level ballast control more simply and less expensively than using a feedback loop ballast.

Another aspect of the present invention provides open loop bi-level ballast control to reduce energy use and expense.

Another aspect of the present invention provides open loop bi-level ballast control using a single ballast per light fixture.

Another aspect of the present invention provides open loop bi-level ballast control that avoids decreasing the useful life of lighting components.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

DETAILED DESCRIPTION OF THE PRESENTLY PREFERRED EMBODIMENT

The present invention provides a system and method for open loop bi-level ballast control allowing multiple levels of illumination from a ballast-driven lamp. Power to a lamp is adjusted in response to a lamp control signal by adjusting the frequency driving the ballast powering the lamp. Line voltage feeds an AC/DC converter, which supplies DC voltage to a high frequency (HF) ballast. A frequency control circuit responds to a lamp control signal and supplies a ballast frequency signal to the HF ballast, which responds to the ballast frequency signal and adjusts the current supplied to the lamp accordingly. In one embodiment, the lamp control signal can be a bi-level signal providing bi-level illumination.

Figure 1:
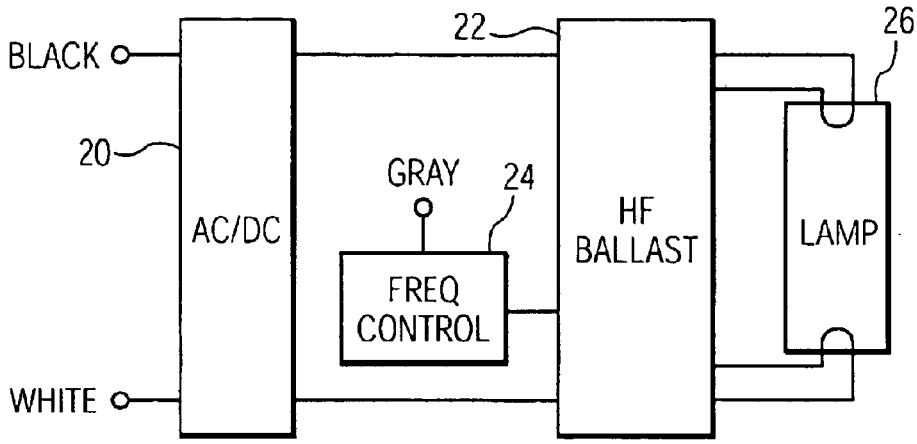
FIG. 1 shows a block diagram of an open loop bi-level ballast control system made in accordance with the present invention.

FIG. 1 shows a block diagram of an open loop bi-level ballast control system made in accordance with the present invention. Line voltage on the BLACK and WHITE wires feed AC/DC converter 20, which supplies DC voltage to HF ballast 22. Frequency control circuit 24 responds to a lamp control signal on the GRAY wire and supplies a ballast frequency signal to the HF ballast 22, which responds to the ballast frequency signal and adjusts the current supplied to the lamp 26 accordingly.

Power is supplied to an AC/DC converter 20 by the BLACK and WHITE wires. Power is typically supplied at 120 VAC, but can be 277 VAC or another voltage as required for a particular application. The AC/DC converter 20 converts the line AC power into a DC bus voltage. The AC/DC converter 20 can be a simple rectifier bridge or can include a power factor correction stage of either active or passive configuration.

High frequency (HF) ballast 22 receives DC bus voltage from the AC/DC converter 20, is responsive to a ballast frequency signal from frequency control circuit 24, and supplies power to lamp 26. The HF ballast 22 can be an electronic ballast for use with fluorescent lamps. The HF ballast 22 can be an inverter ballast of a design that normally operates at a fixed frequency. Although the frequency control circuit 24 is shown separate from the HF ballast 22, the frequency control circuit 24 can be integral to the HF ballast 22. The AC/DC converter 20, the frequency control circuit 24, and the HF ballast 22 can be contained within a single case for ease of installation.

Frequency control circuit 24 supplies a ballast frequency signal to the HF ballast 22 and is responsive to a lamp control signal from the GRAY wire. In one embodiment, the lamp control signal can be the line or neutral voltage supplying the ballast or even earth ground. In other embodiments, the lamp control signal can be a half wave rectified voltage or other voltages, frequencies, or waveforms as required for particular applications. It is well known to those skilled in the art that the control signal logic levels and voltages can vary and have reversed polarity as required for a particular application. In different embodiments, the lamp control signal can be generated through a manual switch or through automatic control, such as automatic control that senses room occupancy, adjusts by time of day, or adjusts in response to a utility company request to shed load to avoid a brownout situation.

In one embodiment, the frequency control circuit 24 can provide a first ballast frequency signal and a second ballast frequency signal in response to a first lamp control signal and a second lamp control signal, respectively. The first lamp control signal can be voltage applied to the GRAY lead and the second lamp control signal can be voltage is removed. The frequency of the power to lamp 26 from the HF ballast 22 varies depending on the frequency of the ballast frequency signal. Lamp 26 can be one or more fluorescent lamps.

Figure 2:
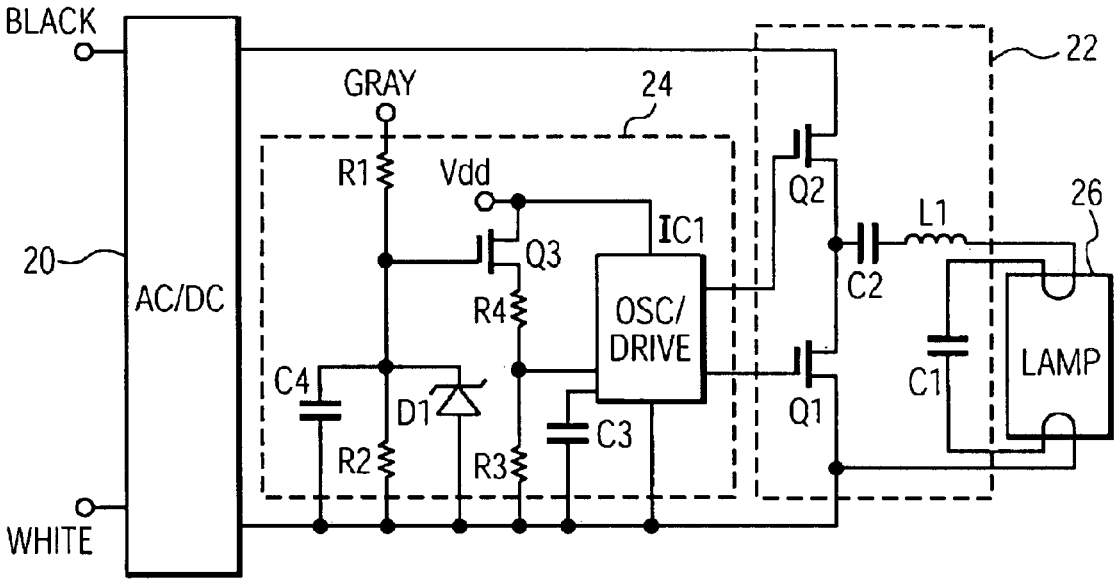
FIG. 2 shows a schematic diagram of an open loop bi-level ballast control system made in accordance with the present invention.

FIG. 2, in which like elements share like reference numbers with FIG. 1, shows a schematic diagram of an open loop bi-level ballast control system made in accordance with the present invention. Line voltage on the BLACK and WHITE wires feed AC/DC converter 20, which supplies DC voltage to HF ballast 22. Frequency control circuit 24 responds to a lamp control signal on the GRAY wire and supplies a ballast frequency signal to the HF ballast 22, which responds to the ballast frequency signal and adjusts the current supplied to the lamp 26 accordingly.

The HF ballast 22 comprises MOSFET Q1, MOSFET Q2, capacitor C1, capacitor C2, and inductor L1, which form a series resonant voltage fed half bridge ballast. As known to those skilled in the art, voltage fed series resonant half bridge ballasts are able to decrease lamp current as their frequency of operation is increased. Frequency control circuit 24 supplies a ballast frequency signal to drive the HF ballast 22.

Frequency control circuit 24 has an oscillator/driver IC1, which determines the frequency of the ballast frequency signal. With no lamp control signal applied to the GRAY wire, the values of capacitor C3 and resistor R3 determine the frequency of an internal oscillator of oscillator/driver IC1. The current "sunk" by resistor R3 determines the charge rate of capacitor C3, which determines frequency.

The lamp control signal applied to the GRAY wire changes the frequency of the ballast frequency signal supplied to the HF ballast 22. The GRAY wire is connected via R1 to the gate of MOSFET Q3, which switches a resistor R4 into the circuit when the voltage at the GRAY wire is high. Current flows from supplied voltage Vdd through MOSFET Q3, resistor R4, and resistor R3. The current sourced via resistor R4 decreases the amount of current "sunk" from the oscillator/driver IC1. This decreases the frequency of the ballast frequency signal and increases current through lamp 26 to produce the high level illumination. Thus, when the voltage at the GRAY wire is high with respect to the circuit ground, the frequency of the HF ballast 22 is low, and the lamp 26 is at high level illumination. When the voltage at the GRAY wire is open, the frequency of the HF ballast 22 is high, and the lamp 26 is at low level illumination. Although this embodiment uses MOSFET Q3 as a switch, those skilled in the art will appreciate that other switching means, such as a bipolar junction transistor, can be used in other embodiments without departing from the present invention.

Capacitor C4 smoothes the voltage at the gate of MOSFET Q3 into a constant DC. The lamp control signal applied to the GRAY wire can be various waveforms, such as a half wave rectified voltage, so capacitor C4 can be used to assure constant DC at MOSFET Q3. Diode D1 is a zener diode used to insure that the voltage at the gate of MOSFET Q3 does not exceed the maximum rated voltage for the gate. Resistor R2 discharges capacitor C4 when voltage is removed from the GRAY wire when switching from high level illumination to low level illumination.

Figure 3:
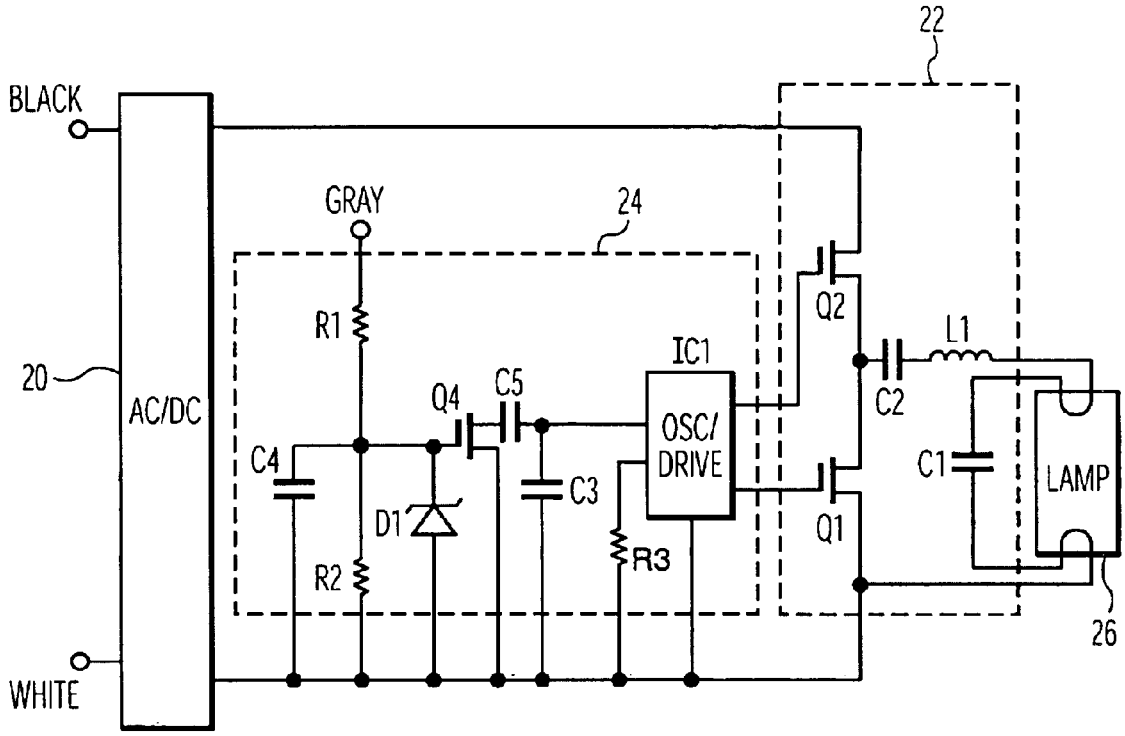
FIG. 3 shows a schematic diagram of an alternate embodiment of an open loop bi-level ballast control system made in accordance with the present invention.

FIG. 3, in which like elements share like reference numbers with FIG. 2, shows a schematic diagram of an alternate embodiment of an open loop bi-level ballast control system made in accordance with the present invention. The switching mechanism switches in an additional capacitance C5 instead of the additional resistance R4 described in FIG. 2. In the alternate embodiment, the parallel combination of capacitors C3 and C5 results in a higher capacitance at the oscillator and hence a lower frequency effecting the same results.

Referring to FIG. 3, voltage on the BLACK and WHITE wires feed AC/DC converter 20, which supplies DC voltage to HF ballast 22. Frequency control circuit 24 responds to a lamp control signal on the GRAY wire and supplies a ballast frequency signal to the HF ballast 22, which responds to the ballast frequency signal and adjusts the current supplied to the lamp 26 accordingly.

The HF ballast 22 comprises MOSFET Q1, MOSFET Q2, capacitor C1, capacitor C2, and inductor L1, which form a series resonant voltage fed half bridge ballast. As known to those skilled in the art, voltage fed series resonant half bridge ballasts are able to decrease lamp current as their frequency of operation is increased. Frequency control circuit 24 supplies a ballast frequency signal to drive the HF ballast 22.

Frequency control circuit 24 has an oscillator/driver IC1, which determines the frequency of the ballast frequency signal. With no lamp control signal applied to the GRAY wire, the values for capacitor C3 and resistor R3 determine the frequency of an internal oscillator of oscillator/driver IC1. The current "sunk" by resistor R3 determines the charge rate of capacitor C3, which determines frequency.

The lamp control signal applied to the GRAY wire changes the frequency of the ballast frequency signal supplied to the HF ballast 22. The GRAY wire is connected via R1 to the gate of MOSFET Q4, which switches a capacitor C5 into the circuit when the voltage at the GRAY wire is high. The capacitance increases at the input to oscillator/driver IC1 at the connection of capacitor C5 and C3, changing the charge rate (dV/dt) of the capacitors. This decreases the frequency of the ballast frequency signal and increases current through lamp 26 to produce the high level illumination. Thus, when the voltage at the GRAY wire is high with respect to the circuit ground, the frequency of the HF ballast 22 is low, and the lamp 26 is at high level illumination. When the voltage at the GRAY wire is open, the frequency of the HF ballast 22 is high, and the lamp 26 is at low level illumination.

Although this embodiment uses MOSFET Q4 as a switch, those skilled in the art will appreciate that other switching means, such as a high voltage power transistor, can be used in other embodiments without departing from the present invention.

Capacitor C4 smoothes the voltage at the gate of MOSFET Q4 into a constant DC. The lamp control signal applied to the GRAY wire can be various waveforms, such as a half wave rectified voltage, so capacitor C4 can be used to assure constant DC at MOSFET Q4. Diode D1 is a zener diode used to insure that the voltage at the gate of MOSFET Q4 does not exceed the maximum rated voltage for the gate. Resistor R2 discharges capacitor C4 when voltage is removed from the GRAY wire when switching from high level illumination to low level illumination.

Although the descriptions presented in FIGS. 2 & 3 provide the example of an open loop ballast control system with bi-level operation, those skilled in the art will appreciate that multi-level operation can be achieved by adding additional switching circuits to provide multiple "current sink" levels to oscillator/driver IC1. The additional switching circuits can effectively vary the relative values of resistors R3 and R4, or capacitors C3 and C5, to produce multiple frequencies for the ballast frequency signal, resulting in multiple illumination levels from lamp 26. Addition of a second switching mechanism can provide the ability to switch between four illumination levels. In one embodiment, a first switch can be used to switch an additional resistance to change frequency a predetermined percentage and a second switch can be used to switch a an additional capacitance to change frequency a second predetermined percentage. Frequency is a function of resistance and capacitance, so altering either resistance or capacitance a fixed percentage will have a corresponding effect on frequency. In another embodiment, both resistance and capacitance can be switched with two different switches. The percentage change for either switch can be made independent of the state of the other switch.

In another embodiment, a second switching mechanism can be used to provide bi-level power with multiple lamp types. For example, if two lamp types are used that have two different operating currents, a capacitor can be switched as in FIG. 3 to provide for two different operating currents for the two lamp types. In addition, a resistor can be switched as in FIG. 2 to give two different illumination levels for the two lamp types.

Figure 4:
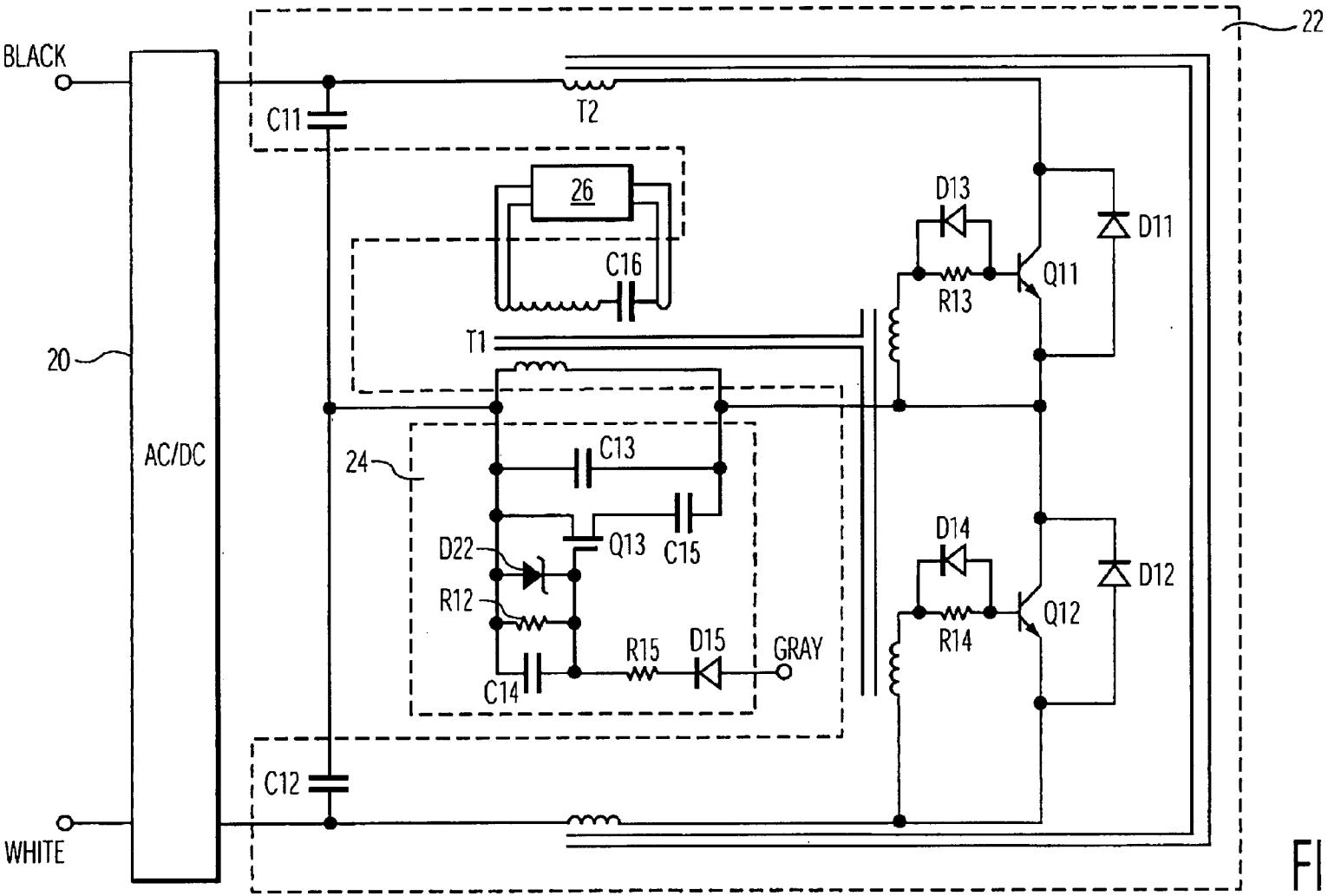
FIG. 4 shows a schematic diagram of yet another alternate embodiment of an open loop bi-level ballast control system made in accordance with the present invention.

FIG. 4, in which like elements share like reference numbers with FIG. 1, shows a schematic diagram of yet another alternate embodiment of an open loop bi-level ballast control system made in accordance with the present invention. Line voltage on the BLACK and WHITE wires feed AC/DC converter 20, which supplies DC voltage to HF ballast 22. Frequency control circuit 24 responds to a lamp control signal on the GRAY wire and supplies a ballast frequency signal to the HF ballast 22, which responds to the ballast frequency signal and adjusts the current supplied to the lamp 26 accordingly.

The HF ballast 22 is a self-oscillating current-fed half-bridge with variable frequency. Although the classic self-oscillating design is well known to those skilled in the art, the design is not normally frequency controlled. With "capacitive ballasting" as provided by capacitor C16, a decrease in ballast frequency will decrease current to the lamp 26 and hence illumination.

Windings coupled to transformer T1 drive transistors Q11 and Q12 via their respective base drives consisting of resistors R13 and R14 and diodes D13 and D14. The startup circuit required for ballast startup is well known to those skilled in the art and has been omitted from FIG. 4. Capacitors C11 and C12 are half-bridge capacitors that divide the DC voltage from the AC/DC converter 20 equally. Transformer T2 is a coupled inductor that acts as a current source to the circuit. A sinusoidal voltage with a peak voltage of Vdc*pi/4 is produced across the primary of transformer T1 with a frequency determined by the parallel resonant frequency of the inductance of transformer T1 and the combined effective parallel capacitance of capacitors C13, C15, and C16. Transformer T1 steps up voltage and applies the voltage across the lamp 26, with lamp current limited by capacitor C16. Windings coupled to transformer T1 heat the filaments of the lamp 26. By switching capacitor C15 into and out of the circuit, frequency can be varied and hence current varied through the lamp 26. In this embodiment, Q13 can be a high voltage type switching transistor or MOSFET. Although this embodiment uses MOSFET Q3 as a switch, those skilled in the art will appreciate that other switching means, such as a bipolar junction transistor, can be used in other embodiments without departing from the present invention.

Capacitor C14 smoothes the voltage at the gate of MOSFET Q13 into a constant DC. The lamp control signal applied to the GRAY wire can be various waveforms, such as a half wave rectified voltage, so capacitor C14 can be used to assure constant DC at MOSFET Q13. Diode D22 is a zener diode used to insure that the voltage at the gate of MOSFET Q13 does not exceed the maximum rated voltage for the gate. Resistor R12 discharges capacitor C14 when voltage is removed from the GRAY wire when switching from high level illumination to low level illumination. Resistor R15 and diode D15, respectively, regulate current flow from and prevent current backflow to the GRAY wire.

Figure 5:
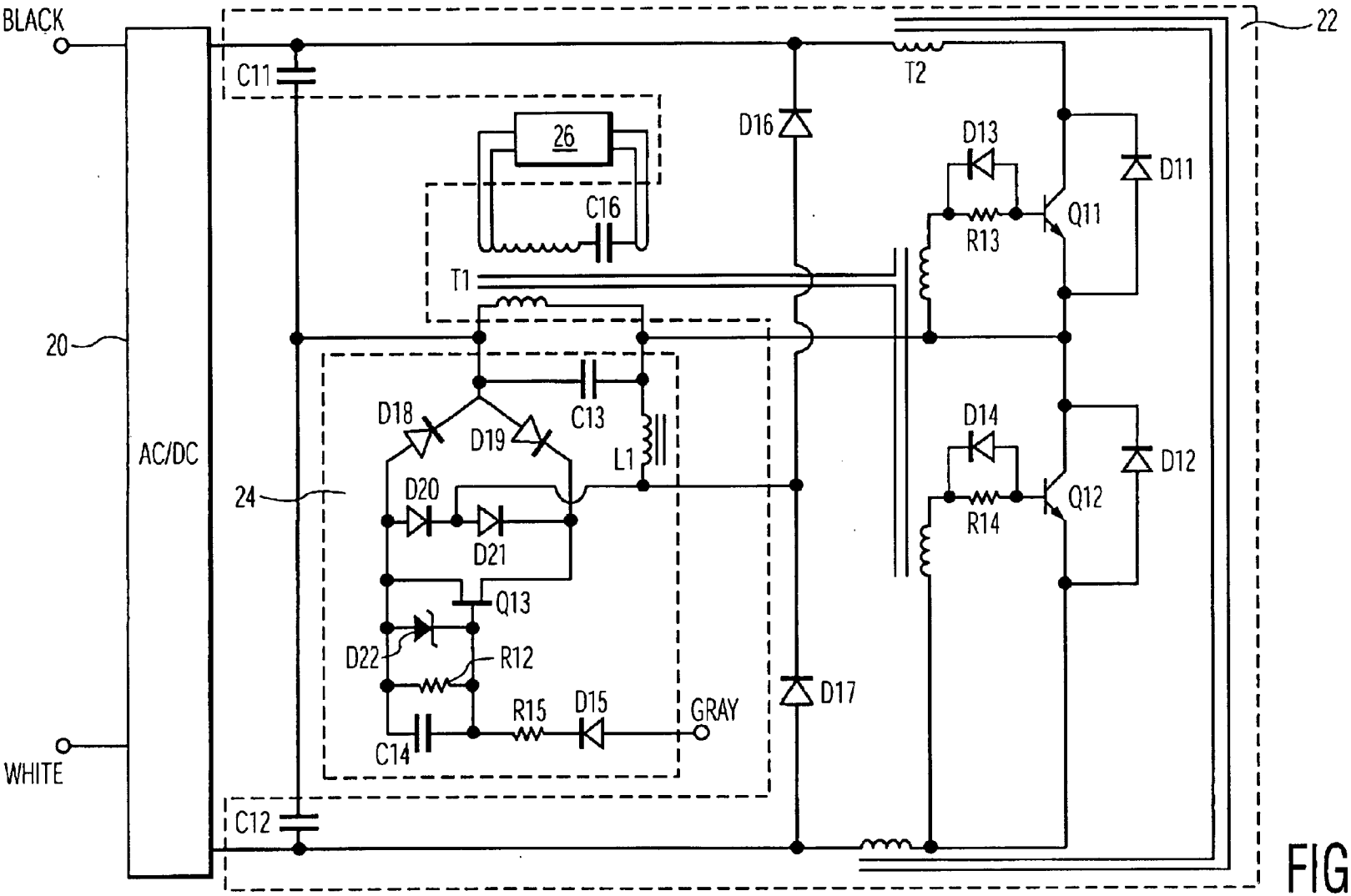
FIG. 5 shows a schematic diagram of yet another alternate embodiment of an open loop bi-level ballast control system made in accordance with the present invention.

FIG. 5, in which like elements share like reference numbers with FIG. 4, shows a schematic diagram of yet another alternate embodiment of an open loop bi-level ballast control system made in accordance with the present invention. The open loop bi-level ballast control system of FIG. 5 is similar to that described in FIG. 4, but switches a tank inductance instead of capacitance. Referring to FIG. 5, line voltage on the BLACK and WHITE wires feed AC/DC converter 20, which supplies DC voltage to HF ballast 22. Frequency control circuit 24 responds to a lamp control signal on the GRAY wire and supplies a ballast frequency signal to the HF ballast 22, which responds to the ballast frequency signal and adjusts the current supplied to the lamp 26 accordingly.

The HF ballast 22 is a self-oscillating current-fed half-bridge with variable frequency. Although the classic self-oscillating design is well known to those skilled in the art, the design is not normally frequency controlled. With "capacitive ballasting" as provided by capacitor C16, a decrease in ballast frequency will decrease current to the lamp 26 and hence, decrease illumination.

Windings coupled to transformer T1 drive transistors Q11 and Q12 via their respective base drives consisting of resistors R13 and R14 and diodes D13 and D14. The startup circuit required for ballast startup is well known to those skilled in the art and has been omitted from FIG. 5. Capacitors C11 and C12 are half-bridge capacitors that divide the DC voltage from the AC/DC converter 20 equally. Transformer T2 is a coupled inductor that acts as a current source to the circuit. A sinusoidal voltage with a peak voltage of Vdc*pi/4 is produced across the primary of transformer T1 with a frequency determined by the parallel resonant frequency of the inductance of transformer T1 and inductor L11, and the combined effective parallel capacitance of capacitors C13 and C16. Transformer T1 steps up voltage and applies the voltage across the lamp 26, with lamp current limited by capacitor C16. Windings coupled to transformer T1 heat the filaments of the lamp 26. By switching inductor L11 into and out of the circuit, frequency can be varied and hence, current varied through the lamp 26. Although this embodiment uses MOSFET Q13 as a switch, those skilled in the art will appreciate that other switching means, such as a high voltage type switching transistor, can be used in other embodiments without departing from the present invention.

Capacitor C14 smoothes the voltage at the gate of MOSFET Q13 into a constant DC. The lamp control signal applied to the GRAY wire can be various waveforms, such as a half wave rectified voltage, so capacitor C14 can be used to assure constant DC at MOSFET Q13. Diode D22 is a zener diode used to insure that the voltage at the gate of MOSFET Q13 does not exceed the maximum rated voltage for the gate. Resistor R2 discharges capacitor C14 when voltage is removed from the GRAY wire when switching from high level illumination to low level illumination. Resistor R15 and diode D15, respectively, regulate current flow from and prevent current backflow to the GRAY wire.

The MOSFET Q13 is placed in a diode bridge (diodes D18, D19, D20, D21) to allow AC switching. Diodes D16 and D17 clamp the voltage when switching off the current through the inductor L11 to avoid flyback current.

Although the descriptions presented in FIGS. 4 & 5 provide the example of an open loop ballast control system with bi-level operation, those skilled in the art will appreciate that multi-level operation can be achieved by adding additional switching circuits to provide multiple frequencies. The additional switching circuits can effectively vary the relative values of capacitance and inductance to produce multiple frequencies for the ballast frequency signal, resulting in multiple illumination levels from lamp 26. Addition of a second switching mechanism can provide the ability to switch between four illumination levels. In one embodiment, a first switch can be used to switch an additional inductance to change frequency a predetermined percentage and a second switch can be used to switch a an additional capacitance to change frequency a second predetermined percentage. Frequency is a function of inductance and capacitance, so altering either inductance or capacitance a fixed percentage will have a corresponding effect on frequency. In another embodiment, both inductance and capacitance can be switched with two different switches. The percentage change for either switch will depend on the state of the other switch.

In another embodiment, a second switching mechanism can be used to provide bi-level power with multiple lamp types. For example, if two lamp types are used that have two different operating currents, a capacitor can be switched as in FIG. 4 to provide for two different operating currents for the two lamp types. In addition, an inductor can be switched as in FIG. 5 to give two different illumination levels for the two lamp types.

It is important to note that FIGS. 1–5 illustrate specific applications and embodiments of the present invention, and are not intended the limit the scope of the present disclosure or claims to that which is presented therein. For example, other switching mechanisms can be used with other topologies of ballast. Upon reading the specification and reviewing the drawings hereof, it will become immediately obvious to those skilled in the art that myriad other embodiments of the present invention are possible, and that such embodiments are contemplated and fall within the scope of the presently claimed invention.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A circuit for bi-level control of a lamp, comprising:

a frequency control circuit responsive to a lamp control signal and providing a ballast frequency signal, said frequency control circuit comprising an oscillator/driver operating at a frequency and a variable impedance operably connected to the oscillator/driver and controlling the frequency of the oscillator/driver in response to the lamp control signal;

an HF ballast responsive to the ballast frequency signal, the HF ballast providing power to the lamp;

wherein the ballast frequency signal adjusts the frequency of the HP ballast to adjust the power to the lamp in accordance with the lamp control signal between a first power level and a second power level to produce a first level or a second level of luminance from said lamp;

wherein resistance of the variable impedance is varied to control the frequency of the oscillator/driver.

2. The circuit of claim 1 wherein resistance and capacitance of the variable impedance are varied to control the frequency of the oscillator/driver.

3. The circuit of claim 1 wherein the lamp control signal is selected from the group consisting of line voltage, neutral, and earth ground.

4. A system for bi-level control of a lamp or a single group of lamps, said system comprising:

frequency controlling means responsive to a lamp control signal by providing a ballast frequency signal; and power generating means for providing power to the lamp in response to the ballast frequency signal;

wherein the ballast frequency signal adjusts the frequency of the power generating means to adjust the power to the lamp in accordance with the lamp control signal between a first power level and a second power level to produce two levels of luminance; and wherein the frequency controlling means further comprises means for changing the ballast frequency signal by varying resistance.

5. The system of claim 4 wherein the frequency controlling means comprises means for changing the ballast frequency signal by varying inductance.

6. The system of claim 4 wherein the frequency controlling means comprises:

means for oscillating, the oscillating means operating at a frequency; and means for controlling resistance-capacitance, the resistance-capacitance controlling means operably connected to the oscillating means and controlling the frequency of the oscillating means in response to the lamp control signal.

7. The system of claim 6 wherein resistance of the resistance-capacitance controlling means is varied to control the frequency of the oscillating means.

8. The system of claim 6 wherein resistance and capacitance of the resistance-capacitance controlling means are varied to control the frequency of the oscillating means.

9. The circuit of claim 4 wherein the lamp control signal is selected from the group consisting of line voltage, neutral, and earth ground.

* * * * *